United States Patent [19]

Tol

[11] 4,230,304

[45] Oct. 28, 1980

[54] ARRANGEMENT TO OBTAIN EQUAL TRAVEL OF HYDRAULIC CYLINDERS

[75] Inventor: Dirk Tol, Oud Beijerland, Netherlands

[73] Assignee: ITT Industries, Inc., New York, N.Y.

[21] Appl. No.: 974,038

[22] Filed: Dec. 26, 1978

[30] Foreign Application Priority Data

Dec. 12, 1977 [NL] Netherlands ..... 7713705

[51] Int. Cl.[3] ..... B66F 7/20

[52] U.S. Cl. ..... 254/89 H

[58] Field of Search ..... 91/171; 254/89 H, 89 R; 280/6.1

[56] References Cited

U.S. PATENT DOCUMENTS

| | | | |
|---|---|---|---|
| 2,441,925 | 5/1948 | Wege | 91/171 |
| 3,143,924 | 8/1964 | Pearson et al. | 91/171 |
| 3,241,458 | 3/1966 | Goldie | 91/171 |
| 3,355,993 | 12/1967 | Williamson | 91/171 |

FOREIGN PATENT DOCUMENTS

| | | | |
|---|---|---|---|
| 2308475 | 8/1974 | Fed. Rep. of Germany | 91/171 |

*Primary Examiner*—Robert C. Watson

*Attorney, Agent, or Firm*—James B. Raden; William J. Michals

[57] ABSTRACT

The invention relates to an arrangement to obtain an equal travel of hydraulic cylinders, particularly on behalf of a hydraulic car lift hauling at least two single acting lifting cylinders, powered by a common pressure source and with which a lifting platform can be moved which is maintained in a substantially horizontal position by means of the equal-travel arrangement, to which end both cylinders are connected to a control arrangement which itself is controlled by a leveling arrangement which is influenced by the position of the platform.

1 Claim, 1 Drawing Figure

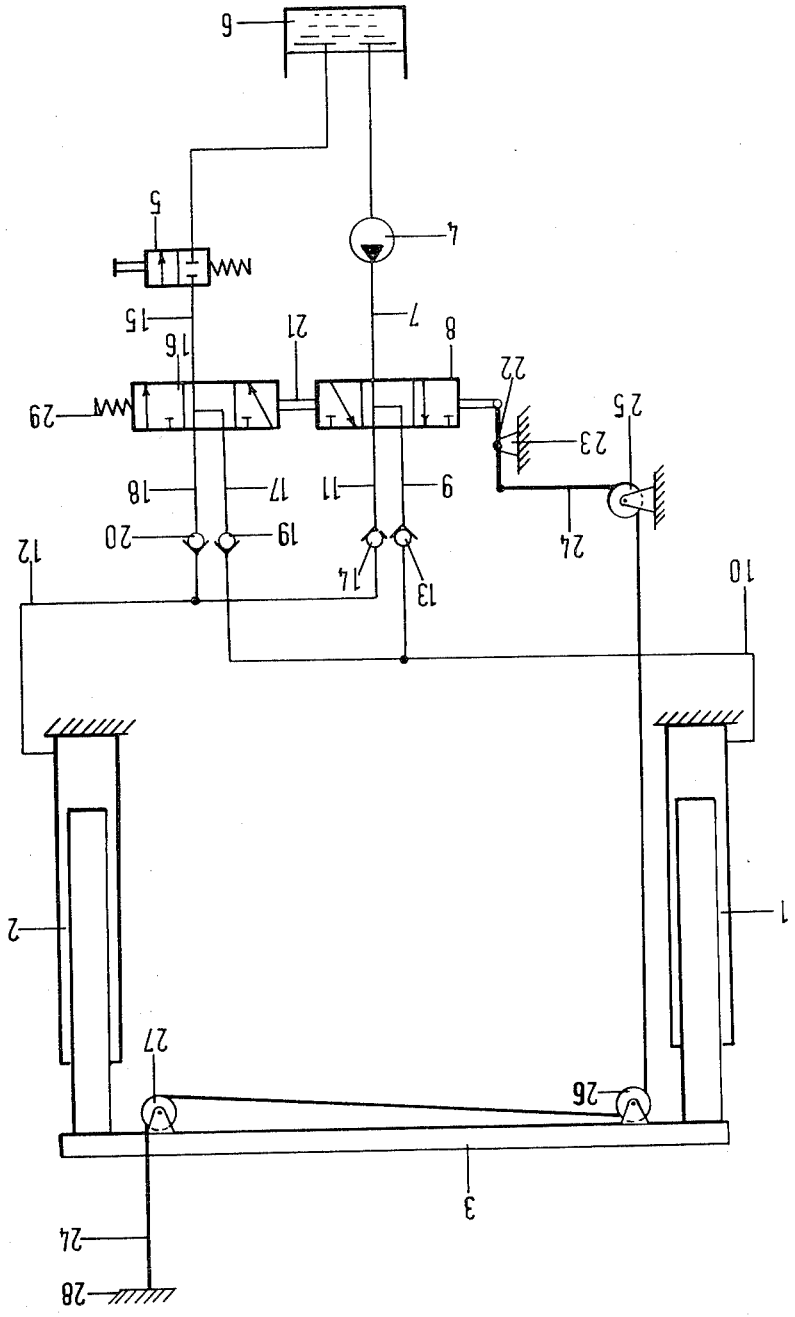
1
2
3
4
5
6
7
8
9
10
11
12
13
14
15
16
17
18
19
20
21
22
23
24
25
26
27
28
29

ARRANGEMENT TO OBTAIN EQUAL TRAVEL OF HYDRAULIC CYLINDERS

In such prior art arrangement the equal-travel arrangement is coupled with each cylinder through a non-return valve opening in the direction of said cylinder, which non-return valves should be opened in order to lower the platform. Said opening is effected hydraulically for which the pressure source is to be used and for which additional pipelines to the non-return valves must be provided.

Besides the use of sophisticated pressure-operated non-return valves which are subject to failure, energy must be supplied in said prior art arrangement to enable the lowering of the platform, which takes place by its own weight and in which energy is just liberated. Moreover it is not possible without additional provisions to lower the platform if the pump is out of service e.g. by mains failure.

The object of the present invention is to provide an arrangement having less sophisticated control means and in which during the lowering of the platform the pressure source is left out of service.

According to the present invention the arrangement is characterized in that the control arrangement is formed by two control members which are rigidly interconnected and controlled by the leveling arrangement, the upward control member of which only controlling the upward movement of the platform and the downward control member only controlling the downward movement, that the upward control member is connected to the pressure pump and the downward control member is connected to a singular valve, that non-return valves are inserted in the two pipelines to the corresponding cylinders which open in the direction towards the cylinders and that non-return valves are inserted in the two pipelines from the downward control member to the corresponding cylinders which open in the direction towards the downward control member.

The invention will be explained further with reference to an embodiment shown in the related drawing in which the single FIGURE represents a schematic diagram of the arrangement according to the present invention.

In the FIGURE 1 and 2 are single acting cylinders of a car lift, with which a platform 3 can be lifted and lowered. The pressure source for the raising movement is formed by a hydraulic pump 4, while the lowering is controlled through a manually operated valve 5. Both the suction side of the pump 4 and the outlet side of the valve 5 are connected to a medium reservoir 6. The pressure side of the pump 4 is connected through a pipeline 7 to an upward control member 8, from which pipelines 9, 10 and 11, 12 lead to cylinders 1 and 2. Non-return valves 13 and 14 opening in the direction towards the cylinders 1 and 2 are arranged in the pipelines 9 and 11. Through pipeline 15 the inlet of the valve 5 is connected to a downward control member 16, which is coupled through the pipelines 17 and 18 with pipelines 10 and 12, which are connected to the cylinders 1 and 2 respectively. In the pipelines 17 and 18 non-return valves 19 and 20 are inserted, which can open in the direction towards the control member 16. The two control members 8 and 16 are rigidly interconnected at 21 and can be moved simultaneously by a lever 22 pivotly arranged in its centre of rotation 23.

The position of lever 22 is governed by the tilt of the platform by means of a drawing cable 24, which passes a stationary pulley 25 and two pulley's fixed to the platform and is fastened to a stationary point 28. The drawing cable is all the time stretched by pressure spring 29.

The operation is as follows:

After switching on the pump 4 pressure medium from the reservoir 6 is distributed over the pipelines 9 and 11 through pipeline 7 with control member 8 in the position as shown; after opening the non-return valves 13 and 14 pressure medium is forced through pipelines 10 and 12 to the cylinders 1 and 2 respectively, whereby platform 3 will be raised.

Any leading of cylinder 1 will cause the drawing cable 24 to become "shorter" and the lever 22 to turn such, the the upward control member 8 will shift to the position shown left in the diagram. Thereby the medium supply to cylinder 1 is cut off and only cylinder 2 is supplied with pressure medium, until the horizontal position of the platform 3 is restored and the upward control member 8 is returned in the position shown. Any leading of cylinder 2 will cause the drawing cable 24 to become "longer" and the control member 8 will shift under influence of the spring 29 into the position shown right in the diagram. Hereby the supply to cylinder 2 is cut off so that only medium is pumped to cylinder 1 until the position shown is recovered. The lowering of the platform is accomplished by manually operating the valve 5 so that the cylinders 1 and 2 can communicate through pipelines 10, 17 and 12, 18 respectively and after opening of the non-return valves 19 and 20 through downward control member 16 and pipeline 15 with reservoir 6.

Because the control means 8 and 16 are intercoupled they will both perform equal motions when the platform tends to a tilted position so that the leading of any of the cylinders when the platform is lowering is cancelled in the same way by the downward control member 16 as is described above with respect to the leading of one of the cylinders when the platform is raised under control of the upward control member 8.

The non-return valves 13, 14 and 19, 20 are inserted so as to prevent a direct connection between both cylinders 1 and 2.

When a car lift is provided with more than two cylinders each additional cylinder can be provided with an additional arrangement to obtain an equal travel.

I claim:

1. An arrangement to obtain an equal travel of hydraulic cylinders in a hydraulic car lift having at least two single acting lifting cylinders powered by a common pressure source and with which a lifting platform is moved, is maintained in a substantially horizontal position by means of a leveling arrangement, and both cylinders being connected to a control arrangement which itself is controlled by the leveling arrangement which is influenced by the position of the platform, wherein the control arrangement is formed by two control valve members which are rigidly interconnected and controlled by the leveling arrangement, wherein one of the control members forms an upward control member which only controls the upward movement of the platform and the other control member forming downward control member only controlling the downward movement, the upward control member being connected to the pressure pump and the downward control member being connected to a discharge valve, said upward control member being respectively connected to said cylinders by a pair of pipelines and said downward control member being respectively connected to said cylinders by a second pair of pipelines, and wherein a pair of non-return valves are respectively inserted in the two pipelines from the upward control member to the corresponding cylinders which open in the direction towards the cylinders and a second pair of non-return valves are respectively inserted in the two pipelines from the downward control member to the corresponding cylinders which open in the direction towards the downward control member.

* * * * *